US011432658B2

(12) United States Patent
Sherman et al.

(10) Patent No.: US 11,432,658 B2
(45) Date of Patent: Sep. 6, 2022

(54) COLLAPSIBLE BED BASE

(71) Applicant: PPJ, LLC, Natick, MA (US)

(72) Inventors: Philip Reid Sherman, Melville, NY (US); Horace Robert Eskridge, III, Lexington, KY (US); Philip Woods McCarty, Natick, MA (US); Chuan-Hang Shih, Changhua County (TW)

(73) Assignee: PPJ, LLC, Natick, MA (US)

( * ) Notice: Subject to any disclaimer, the term of this patent is extended or adjusted under 35 U.S.C. 154(b) by 649 days.

(21) Appl. No.: 16/255,293

(22) Filed: Jan. 23, 2019

(65) Prior Publication Data

US 2019/0223609 A1 Jul. 25, 2019

Related U.S. Application Data

(60) Provisional application No. 62/620,633, filed on Jan. 23, 2018.

(51) Int. Cl.

| | |
|---|---|
| ***A47C 20/04*** | (2006.01) |
| ***A47C 19/12*** | (2006.01) |
| ***A47C 27/14*** | (2006.01) |
| ***A47C 19/02*** | (2006.01) |
| ***A47C 19/00*** | (2006.01) |

(52) U.S. Cl.

CPC ..... *A47C 20/041* (2013.01); *A47C 19/005* (2013.01); *A47C 19/027* (2013.01); *A47C 19/122* (2013.01); *A47C 27/14* (2013.01)

(58) Field of Classification Search

CPC ... A47C 20/041; A47C 19/122; A47C 19/005; A47C 19/027; A47C 19/025; F16B 12/54

See application file for complete search history.

(56) References Cited

U.S. PATENT DOCUMENTS

| | | | | |
|---|---|---|---|---|
| 893,364 | A * | 7/1908 | Piaser | A47C 17/48 5/149 |
| 3,277,501 | A * | 10/1966 | Frisz | A47C 20/042 5/617 |
| 5,438,723 | A * | 8/1995 | Carroll | A47C 19/122 16/267 |
| 10,743,673 | B2 * | 8/2020 | Choi | F16B 12/56 |
| 2017/0325592 | A1 * | 11/2017 | Suh | A47C 20/041 |
| 2018/0338625 | A1 * | 11/2018 | Nava | A47C 19/02 |

FOREIGN PATENT DOCUMENTS

| | | | | |
|---|---|---|---|---|
| CN | 206507637 U | * | 9/2017 | A47C 19/005 |

OTHER PUBLICATIONS

English translation of CN 206507637 (Year: 2017).*

* cited by examiner

*Primary Examiner* — Peter M. Cuomo
*Assistant Examiner* — Amanda L Bailey
(74) *Attorney, Agent, or Firm* — Michael N. Haynes; Michael Haynes PLC

(57) ABSTRACT

A bed base is configured as a light weight, collapsible bed base having a plurality of separate and independent bed sections. A pair of brackets are provided, and each bracket is releasably attachable to each one of the plurality of separate and independent bed sections to form the bed base. The plurality of separate and independent bed sections connected only through the pair of brackets.

18 Claims, 8 Drawing Sheets

300

COLLAPSIBLE BED BASE

TECHNICAL FIELD

Embodiments of the subject matter disclosed herein relate to bedding including adjustable, articulating bedding systems.

BACKGROUND

Conventional bedding products, including bases, fixed and adjustable foundations and mattresses, are purchased at a store. Some in-home assembly of the bedding products is required. The size and weight of conventional bedding products, however, can make assembly of the bedding products difficult for the purchaser. This difficulty increases with increased weight of the bedding products, for example, the increased weight associated with adjustable bedding products.

The growth of online, e.g., web-based and direct-to-consumer, shopping creates a need for bedding products that can be shipped and delivered directly to consumers using common shipping carriers. The ability to use these common carriers, and the cost associated with shipping, is governed by size and weight restrictions imposed by the carrier. The size and weight of conventional bedding products, and in particular adjustable bedding products, limit the shipping methods or carriers that can be used for delivery due to these size and weight restrictions.

Difficulties associated with in-home assembly of bedding products and the need to meet the size and weight restrictions imposed by shipping carriers create a desire for bedding products, including adjustable bedding products, that are cost-effectively shipped directly to an end consumer using a low-cost carrier. These bedding products would fit within the existing size and weight restrictions of those carriers and would be easily assembled by the consumer.

SUMMARY

Exemplary embodiments are directed to bed bases that are collapsible or that can be disassembled for easy shipping and storage. Exemplary embodiments are also directed to bed assemblies incorporating those bed bases. The bed assemblies include the bed bases in combination with, for example, at least one of mattresses, head boards and footboards. Suitable sizes for the bed bases and bed assemblies include double, full, queen, king and California king. In one embodiment, the bed base is arranged as a plurality of components that can be assembled for use and disassembled for shipping and storage. The disassembled components are separate and independent pieces and are completely detached from each other.

The disassembled components are positioned and arranged into a compact configuration for shipment. This compact configuration has a size, i.e., length, width and height, that meets or exceeds the size and weight restrictions for shipping direct to a customer or consumer using common shipping carriers. In addition, the compact configuration almost doubles the number of bed bases or bed assemblies that can be shipped in a cargo container, e.g., from about 141 bed bases to about 240 bed bases. The length and width components of the compact dimensions of the bed base depend on the assembled size of the bed base, e.g., double or queen. In one embodiment, the compact configuration has a length of less than half the length of the bed frame when assembled, e.g., about 33 inches, and a width that corresponds to the width of the resulting assembled bed. The height or thickness of the compact dimensions, however, can be consistent across multiple bed frame sizes. In one embodiment this height is less than about 8 inches, preferably less than about 7.5.

In addition to the compact dimensions associated with the disassembled bed base, the bed base or bed assembly has an overall weight of less than about 100 lbs. In one embodiment, this light weight is achieved using lightweight framing and decking materials. These lightweight framing materials are selected based on type of framing member, thickness of material and type of material. The type of framing members includes hollow tubular members having circular or rectangular cross sections. Additional weight reduction is achieved with reduced thickness, i.e., wall thickness, of the material of the framing member. Suitable materials for the framing members include, but are not limited to, metals including steel, aluminum, and chrome-molybdenum, plastics and polymers and carbon fiber. The decking materials are selected to be lightweight materials, for example, cloth or mesh materials. Suitable mesh materials include polyethylene terephthalate (PET). The mesh material is attached to a decking frame and stretched taut.

The plurality of separate and independent components of the bed base include a head section, a center section and a foot section. The foot and head sections each include fixed frames and one or more decking sections. The decking sections can be fixed decking sections or adjustable or articulating decking sections. The center section is a center decking section. For embodiments with articulating decking sections, the bed base includes the actuators, motors and other control mechanisms to provide the desired articulation.

The plurality of components also includes a pair of brackets. Each bracket is releasably attachable to the plurality of sections of the bed base. In one embodiment, the plurality of components also includes a plurality of removable and adjustable leg assemblies. In one embodiment, the plurality of components includes six leg assemblies. In another embodiment, the plurality of components includes two leg assemblies, and each leg assembly contains two legs. The leg assemblies can be attached to any one of the plurality of sections of the bed base and the bracket.

When the bed base is disassembled and placed in the compact configuration for shipping or storage, all components are stored within the sections and compact dimensions of the bed base. In one embodiment, a foam mattress such as a memory foam mattress is compressed and wrapped around at least of portion of the bed based in the compact configuration. Therefore, the bed base can be shipped as a bed assembly with a mattress. However, the assembled bed base, either in a fixed or adjustable configuration can be used with any type of mattress.

Exemplary embodiments are directed to a bed base containing a plurality of separate and independent bed sections and a pair of brackets. In one embodiment, the plurality of bed sections is three bed sections. Each bracket is independent of and attachable to the plurality of bed sections to assemble the plurality of bed sections into the bed base. The plurality of bed sections when assembled into the bed base are connected only through the pair of brackets. In one embodiment, the pair of brackets are identical brackets.

When the plurality of bed sections is three bed sections, the three bed sections include a head section, a center section and a foot section. At least one of the head section and the foot section is an articulating bed section. In one embodiment, the head section includes a head section fixed frame and at least one head section decking portion attached to the head section fixed frame. Each bracket is attachable to the head section fixed frame. In one embodiment, the head section also includes a head section fixed decking portion fixedly attached to the head section fixed frame, a head section articulating decking portion pivotally attached to the head section fixed frame and a head section actuator disposed between the head section fixed frame and the head section articulating decking portion to articulate the head section articulating decking portion with respect to the head section fixed frame. In one embodiment, each head section decking portion is mesh decking.

In one embodiment, the foot section includes a foot section fixed frame and at least one foot section decking portion attached to the foot section fixed frame. Each bracket is attachable to the foot section fixed frame. In one embodiment, the foot section further also includes a foot section first articulating decking portion pivotally attached to the foot section fixed frame, a foot section second articulating decking portion pivotally attached to the foot section first articulating decking portion and the foot section fixed frame and a foot section actuator disposed between the foot section first articulating decking portion and the foot section fixed frame to articulate the foot section first articulating decking portion and the foot section second articulating decking portion with respect to the foot section fixed frame. In one embodiment, each foot section decking portion is mesh decking.

In one embodiment, the center section is a center decking portion, and each bracket is attachable to the center decking portion. In one embodiment, the center decking portion is mesh decking. In one embodiment, each bracket contains a pair of alignment holes and a pair of bracket fastener holes. The head section includes a head section fixed frame having a pair of head section alignment pins and a pair of head section fastener holes. Each head section alignment pin is positioned to engage one of the alignment holes of one of the brackets and to align one of the head section fastener holes with one of the bracket fastener holes of one of the brackets when each bracket is attached to the head section fixed frame. The foot section includes a foot section fixed frame have a pair of foot section alignment pins and a pair of foot section fastener holes. Each foot section alignment pin is positioned to engage one of the alignment holes of one of the brackets and to align one of the foot section fastener holes with one of the bracket fastener holes of one of the brackets when each bracket is attached to the foot section fixed frame.

In one embodiment, each bracket also includes a center section fastener hole, and the bed base also includes a pair of center section fasteners. Each center section fastener passes through the center section fastener hole of one of the brackets and into the center section. The bed base includes a pair of head section fasteners. Each head section fastener passes through one of the bracket fastener holes of one of the brackets and into one of the head section fastener holes. The bed base includes a pair of foot section fasteners. Each foot section fastener passes through one of the bracket fastener holes of one of the brackets and into one of the foot section fastener holes. Each one of the head section fasteners and foot section fasteners is a threaded fastener with a knurl knob.

In one embodiment, the bed base further includes a plurality of leg assemblies. Each leg assembly is attachable to one of the plurality of separate and independent bed sections or one of the brackets. In one embodiment, the plurality of leg assemblies includes two leg assemblies. Each leg assembly is attachable to one of the brackets and comprising two separate legs. In one embodiment, the bed base has a total weight of less than about 100 lbs.

Exemplary embodiments are also directed to a bed assembly containing a bed base with three of separate and independent bed sections. These sections includes a head section with a head section fixed frame, a head section articulating decking portion pivotally attached to the head section fixed frame and a head section actuator disposed between the head section fixed frame and the head section articulating decking portion to articulate the head section articulating decking portion with respect to the head section fixed frame. The sections also include a center section comprising a center decking portion, and a foot section. The foot section contains a foot section fixed frame, a foot section first articulating decking portion pivotally attached to the foot portion fixed frame, a foot section second articulating decking portion pivotally attached to the foot section first articulating decking portion and the foot section fixed frame and a foot section actuator disposed between the foot section first articulating decking portion and the foot section fixed frame to articulate the foot section first articulating decking portion and the foot section second articulating decking portion with respect to the foot section fixed frame.

The assembly includes a pair of brackets. Each bracket is independent of and attachable to the head section fixed frame, foot section fixed frame and the center decking portion to assemble the three bed sections into the bed base. The three bed sections when assembled into the bed base connect only through the pair of brackets. The assembly includes a plurality of leg assemblies. Each leg assembly is attachable to the head section fixed frame, the foot section fixed frame, the center decking portion or one of the brackets. The assembly also includes a compressible foam mattress.

In one embodiment, the head section articulating decking portion, the center decking portion, the foot section first articulating decking portion and the foot section second articulating decking portion are mesh decking. In one embodiment, the bed assembly has a total weight of less than about 100 lbs.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

Figure 1:
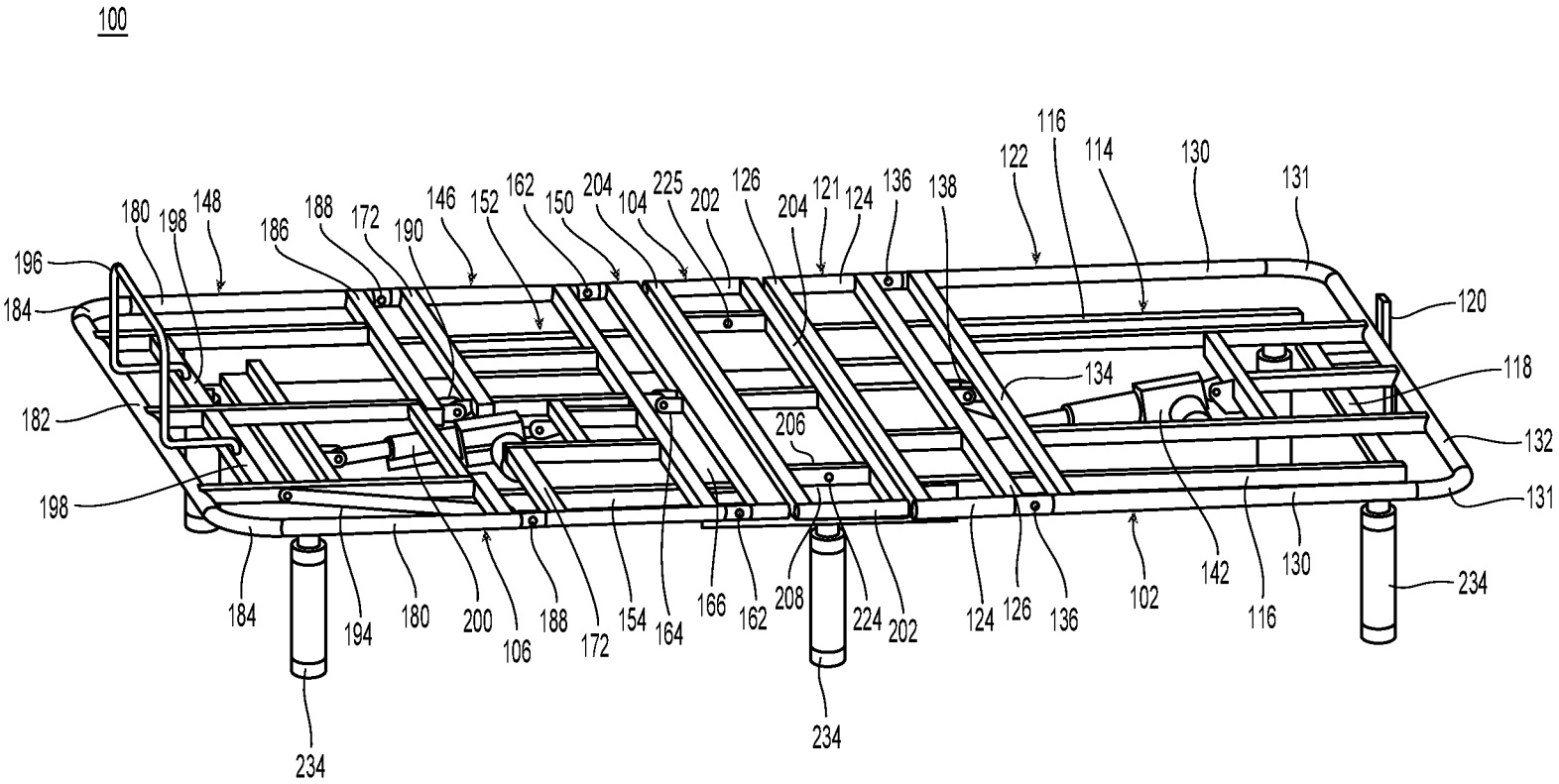
FIG. 1 is a perspective view from the top of an embodiment of a bed base in an assembled configuration.

The following description of the embodiments refers to the accompanying drawings. The same reference numbers in different drawings identify the same or similar elements. The following detailed description does not limit the invention. Instead, the scope of the invention is defined by the appended claims.

Reference throughout the specification to "one embodiment" or "an embodiment" means that a given feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the features, structures or characteristics may be combined in any suitable manner in one or more embodiments.

Referring initially to FIGS. 1, 2, 3 and 4, exemplary embodiments are directed to a bed base 100 having a plurality of separate and independent bed sections. The bed base can be a fixed bed base or an adjustable bed base. Each section can be a fixed section or an adjustable section. For an adjustable bed base, one or more of the plurality of bed sections is an adjustable or articulating bed section. An adjustable section includes all of the components, e.g., framing members and actuators, to provide for adjustment and articulation of that section independent of the other sections. As illustrated, the bed base is an adjustable bed base having two independent adjustable sections. As each section in the plurality of sections is a separate and independent section, the bed base is collapsible or can be disassembled by separating each section from the other sections. Once disassembled, the sections in the plurality of bed sections are arranged in as a compact assembly suitable for shipping, for example, using a common shipping carrier.

In one embodiment as illustrated, the plurality of separate and independent bed sections includes three sections. These three sections are a head section 102, a center section 104 and a foot section 106. The head section corresponds to the head end of the bed, and the foot section corresponds to the foot end of the bed. The three sections are illustrated with the bed base in an assembled position. In the assembled position, the bed base has an over length 108 and an overall width 110 corresponding to the desired size of the assembled bed base, e.g., twin, full, queen, king or California king. The overall length and overall width dimensions associated with the conventional sizes of bed bases are known and available in the art. When assembled, the bed base supports any type of mattress including foam mattresses and innerspring mattresses.

In one embodiment, at least one of the head section and the foot section is an articulating bed section. Therefore, the head section can be a fixed section and the foot section can be an articulating section, or the head section can be an articulating section and the foot section can be a fixed section. In one embodiment as illustrated, both the head section and the foot section are articulating sections. This ability to make each section a fixed section or an articulating section provides for modularity in the selection of sections, as fixed sections and articulating sections, each having corresponding dimensions, are selected to provide the desired configuration in the bed base. In one embodiment, each given section, whether configured as a fixed bed section or articulating section, has the same dimensions, which maintains the overall dimensions of the bed base in the assembled position and as a compact assembly.

In one embodiment, the head section 102 includes a head section fixed frame 114 having a pair of opposing head section side frame rails 116 running along the length of the bed base and a head section end frame rail 118 running along the width of the bed base between the head section side frame rails. Suitable methods for joining the frame rails are known and available in the art and include fasteners and welds. The head section fixed frame supports all components of the head section independent of the other sections. As illustrated, the side frame rails and the head frame rail are configured as rectangular tubing, i.e., hollow tubing having a rectangular cross-section. However, the side frame rails and head frame rail can be cylindrical tubing having a circular or oblong cross-section. In one embodiment, the dimensions of the frame rails, e.g., length and width of a rectangular cross-section or diameter of a circular cross-section, are up to about 3 inches. In addition, the side frame rails can be solid rods, bars, hollow tubes filled with strengthening materials or "I" beams. In general, the configuration of the side frame rails and head frame rail is selected to provide the desired strength with minimal weight. Suitable materials for the side frame rails include, but are not limited to, metals including steel, aluminum, and chrome-molybdenum, plastics and polymers, carbon fiber and combinations thereof. The configuration of frame members, sizes of frame members and materials can be utilized for all components and framing members in all sections and portions of embodiments of the bed base discussed herein.

Figure 2:
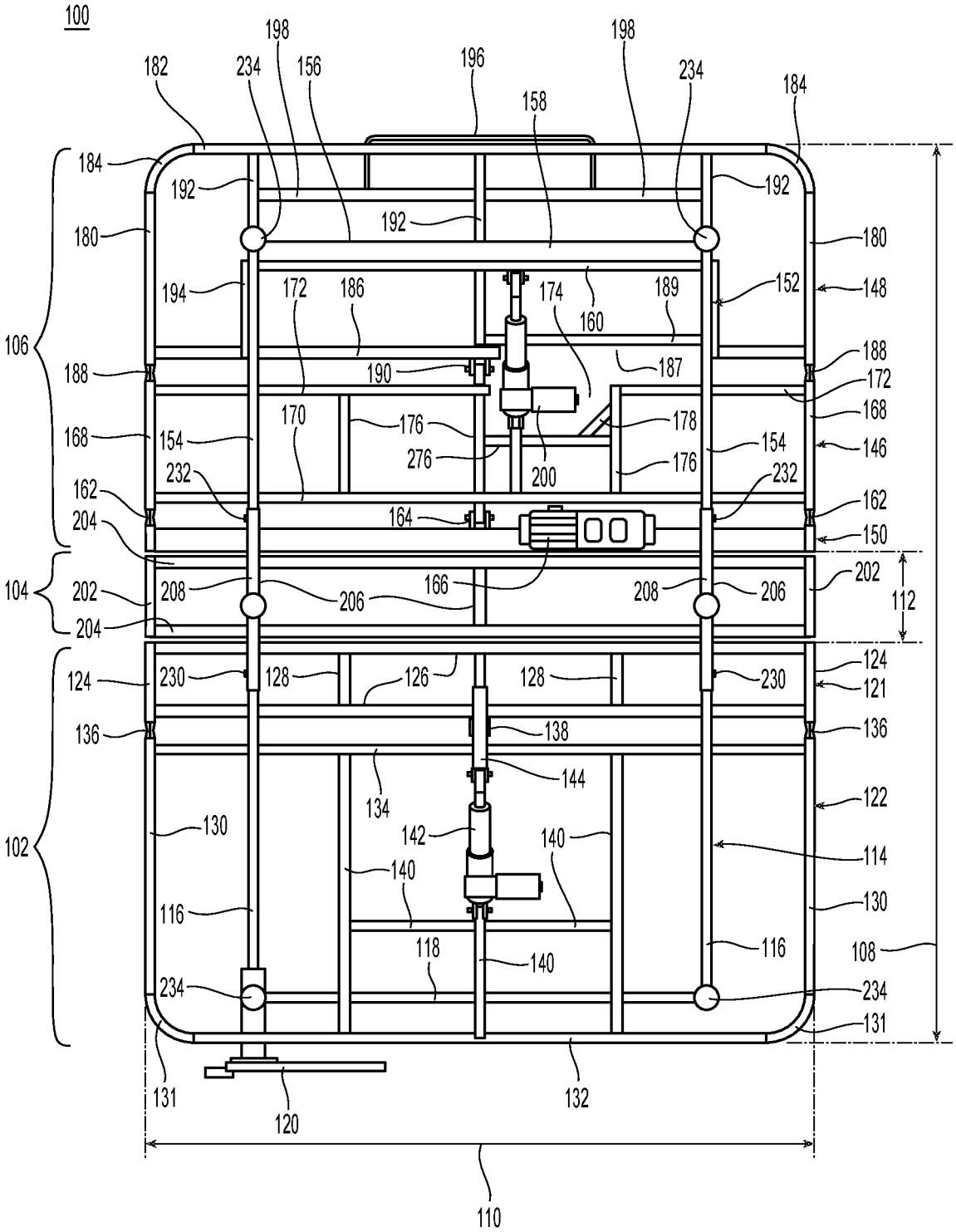
FIG. 2 is a bottom view of the bed base in the assembled configuration.
Figure 3:
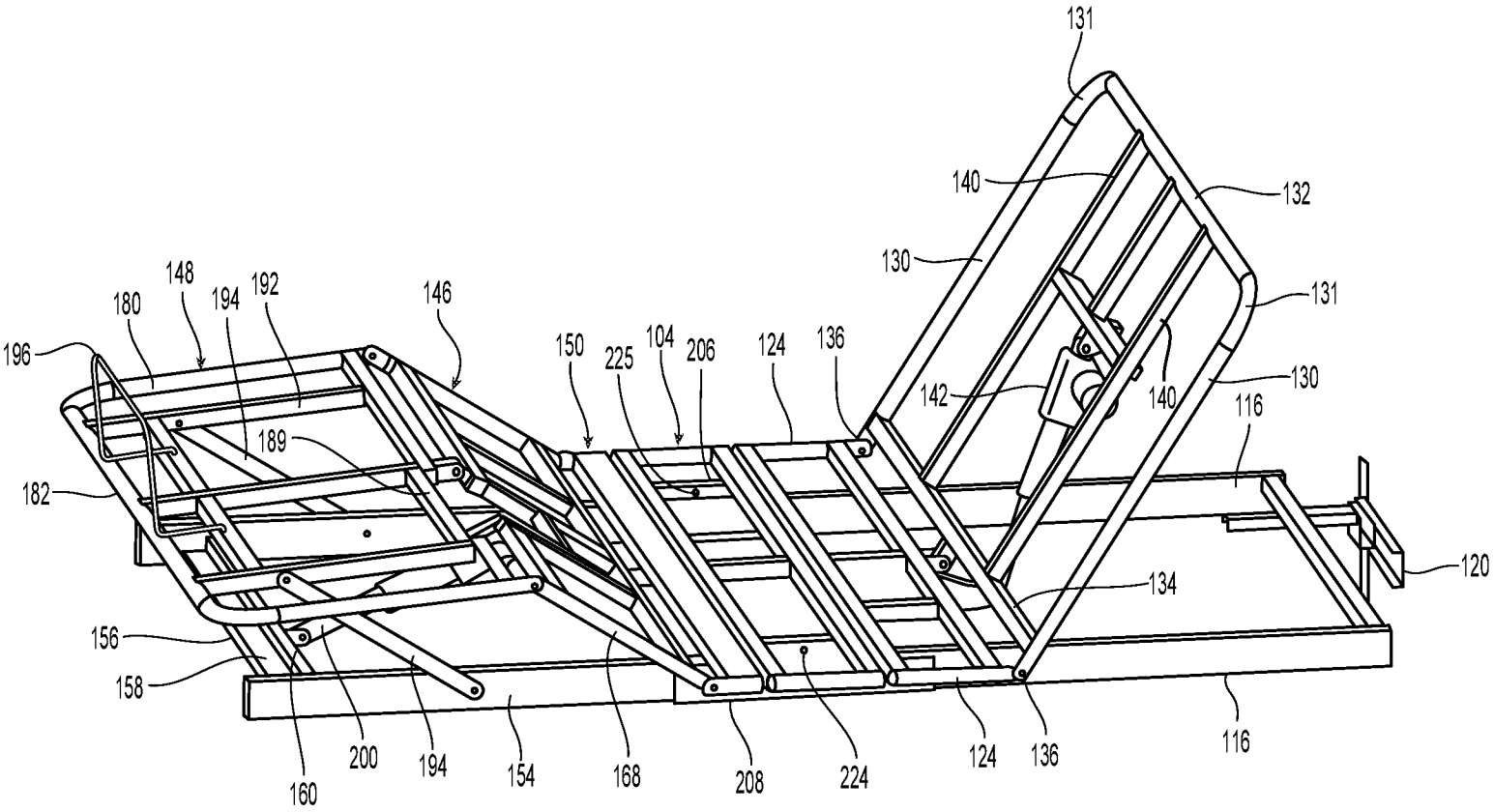
FIG. 3 is a perspective view from the top of an embodiment of a head section, center section and foot section connected with a pair of brackets and the head section and foot section in articulated positions.
Figure 4:
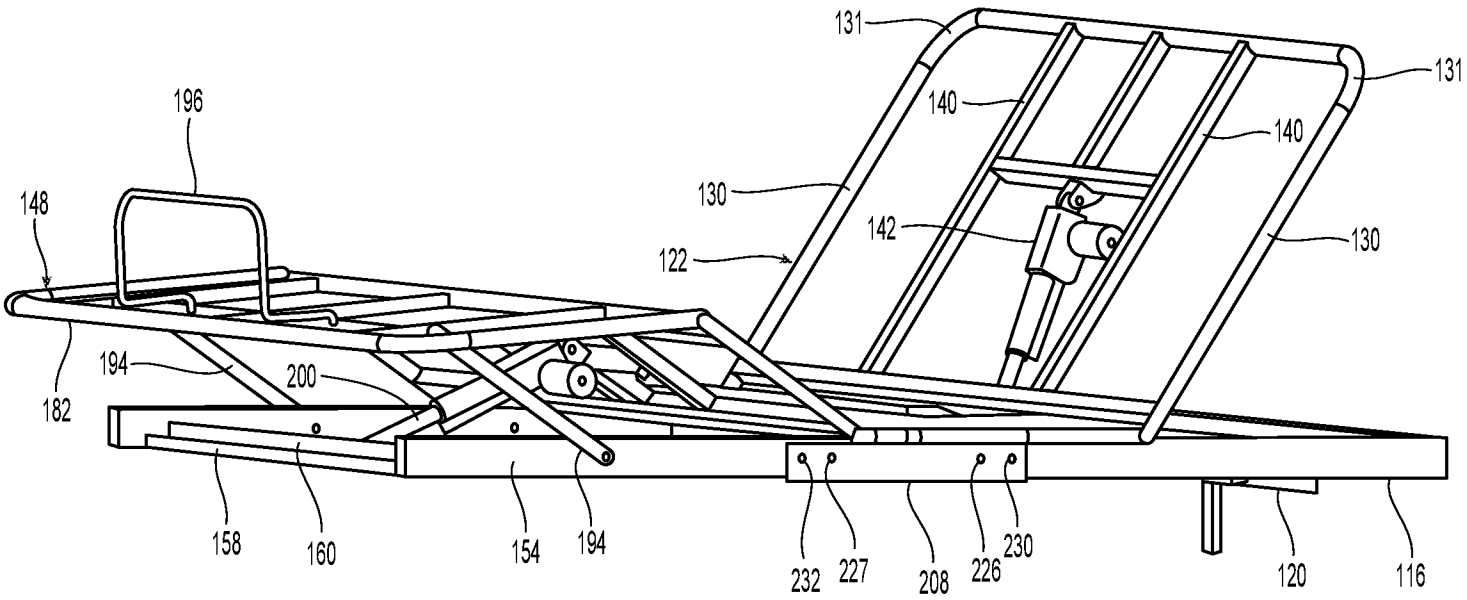
FIG. 4 is a perspective view from the side of an embodiment of a head section, center section and foot section connected with a pair of brackets and the head section and foot section in articulated positions.

The head section includes at least one decking portion attached to the head section fixed frame. Decking portions are fixedly or adjustably attached to the fixed frame and are arranged to support the bedding, e.g., a mattress, that is supported by the bed base. Therefore, each decking portion includes decking portion framing and decking, which is attached to and supported by the framing. As illustrated in FIGS. 1 and 2, only the decking framing is shown. The decking is placed onto the decking framing. The decking is selected to be lightweight. Suitable decking materials include, but are not limited to, solid board decking, wire decking, fabric or cloth decking, non-woven decking, and mesh decking including a weave mesh. Preferably, the decking is a PET mesh decking that is pulled taut over the decking framing and secured to the decking framing using any suitable method known for securing fabric or mesh decking to framing. The decking forms the top surface for the head section decking portion and is positioned on the decking framing opposite the head section fixed frame. This top surface is used to support bedding, for example, a mattress. When the bed base is packaged with a mattress for shipping, the bed base and mattress form a bed base assembly. In one embodiment, this bed base assembly also includes head boards and foot boards. To accommodate attachment of a head board to the bed base in the assembled position, the bed base includes a head board attachment frame 120 that is attached to the head section fixed frame.

In one embodiment, the head section includes a head section fixed decking portion 121 fixedly attached to a portion of the head section fixed frame 114 such that the head section fixed decking portion is supported by the head section fixed frame. Suitable methods for attaching the head section fixed decking section to the head section fixed frame are known and available in the art and include fasteners and welds. Suitable materials for the head section fixed decking portion framing are the same as those for the head section fixed frame. In one embodiment, the head section fixed decking portion framing includes a pair of opposing cylindrical side rails 124 extending along a length of the bed base and a pair of rectangular end rails 126 extending along the width of the bed base. In one embodiment, cylindrical framing is used along the exterior framing members of the decking portions of the bed base. This presents a smooth or rounded edge for the decking and facilitates attachment or wrapping of the cloth or mesh decking to the decking framing. In addition, rectangular or "I" beam framing members are used in the internal framing of the decking sections, as these framing members provide a flat surface for supporting the decking and mattress. The head section fixed decking portion framing also includes a plurality of internal cross frame members 128 to provide the desired rigidity to the head section fixed decking portion and support for the decking.

The head section includes a head section articulating decking portion 122 pivotally attached to the head section fixed frame. The head section articulating decking portion can be directly pivotally attached to the head section fixed frame or can be pivotally attached to the head section fixed frame through the head section fixed decking portion. Suitable materials for the framing of the head section articulating decking portion are the same as those for the head section fixed frame. In one embodiment, the head section fixed decking portion includes a pair of opposing cylindrical side rails 130 extending along a length of the bed base, a cylindrical end rail 132 extending along the width of the bed base at a head end of the assembled bed base and a rectangular end rail 134 extending along the width of the bed base between the sides rails opposite the cylindrical end rail. In one embodiment, the side rails 130 transition to the head end rail 132 at rounded corners 131 formed from cylindrical tubing.

In one embodiment, the cylindrical side rails 130 are pivotally attached to the cylindrical side rails 124 of the head section fixed decking portion at a pair of pivoting joints 136. In one embodiment, the rectangular end rail 134 is pivotally attached to the adjacent rectangular end rail 126 of the head section fixed decking portion framing at an internal pivot point 138. Head section articulating decking portion 122 also includes a plurality of internal cross frame members 140 to provide the desired rigidity to the head section articulating decking portion, support for the decking and support for actuators and other components of the articulating head section.

In one embodiment, the head section includes at least one head section actuator 142 disposed between the head section fixed decking portion framing and the head section articulating decking portion to articulate the head section articulating decking portion with respect to the head section fixed frame. In one embodiment, the actuator is attached to an attachment bracket 144 mounted to one of the rectangular end rails 126 of the head section fixed decking portion framing. In one embodiment, the attachment bracket is mounted at the internal pivot point 138. In one embodiment, the head section actuator is pivotally attached at both ends.

In one embodiment, the head section actuator is a linear actuator. Suitable linear actuators are known and available in the art. The attachment bracket is shaped to assist in translating the linear motion of the actuator into the rotating and articulating motion of the articulating decking portion. Therefore, extending and retracting the linear actuator moves the head section articulating decking portion between a flat position illustrated in FIGS. 1 and 2 and an articulated or raised position illustrated in FIGS. 3 and 4. In the flat position the head section actuator is contained between the decking of the head section and the head section fixed frame. This provides flat surfaces on the top and bottom of the head section for packaging and shipping and minimizes the overall thickness of the head section and the compact assembly of the bed base.

The foot section 106 includes a foot section fixed frame 152 having a pair of opposing foot section side frame rails 154 running along the length of the bed base and a foot section end frame rail 156 running along the width of the bed base between the foot section side frame rails. Suitable methods for joining the frame rails are known and available in the art and include fasteners and welds. In one embodiment, the foot section end frame rail is an "L" shaped rail that is spaced from the foot end of the foot section side frame rails. The foot section end frame rail has a horizontal rail 158 with a larger dimension parallel to the length of the bed base and a vertical rail 160 with a larger dimension perpendicular to the larger dimension of the horizontal rail. The vertical rail provides a mounting surface for components within the foot section and in conjunction with the horizontal rail provides sufficient structural strength to support those components in either a flat or articulated configuration.

The foot section fixed frame supports all components of the foot section independent of the other sections. As illustrated, the side frame rails and the foot frame rail are configured as rectangular tubing, i.e., hollow tubing having a rectangular cross-section. However, the side frame rails and foot frame rail can be cylindrical tubing having a circular or oblong cross-section. The foot section includes at least one decking portion section attached to the foot section fixed frame. Suitable arrangement, materials and attachment of decking to the foot section decking portions are the same as those described herein for the head section decking portions.

In one embodiment, the foot section includes a foot section first articulating decking portion 146 pivotally attached to the foot section fixed frame. In one embodiment, the foot section first articulating decking portion is pivotally attached directly to the foot section fixed frame. Alternatively, the foot section includes a foot section fixed decking portion 150 that is fixedly attached to the foot section fixed frame. In one embodiment, the foot section fixed decking portion is a rectangular frame member, e.g., hollow rectangular tubing. Suitable shapes, sizes, wall thicknesses and materials for the rectangular tubing are disclosed herein. The rectangular frame member has a length that extends along the width of the bed base, and the long dimension of the rectangular frame member extends along the foot section fixed frame in the direction of the length of the bed base. The foot section first articulating decking portion is pivotally attached to the foot portion fixed frame by the foot portion fixed decking section. In one embodiment, the foot section first articulating decking portion is pivotally attached to the foot section fixed decking portion at a pair of external, outside or edge pivoting joints 162 and at least one internal pivot point 164. Any suitable arrangement of pivot joints known and available in the art can be used.

In one embodiment, the bed base includes a control module 166 attached to the bottom of the foot section fixed decking portion opposite the top surface or decking of the bed base. The control module is completely contained between the decking of the foot section and the bottom of the foot section fixed frame. This provides flat surfaces on the top and bottom of the head section for packaging and shipping and minimizes the overall thickness of the head section and the compact assembly of the bed base. The control module is in communication with the actuators, external power sources and wired or wireless controllers of the adjustable bed base. The control module includes the control electronics, transformers, batteries, wired and wireless communication modules and other components utilized for operation of the adjustable bed base. In one embodiment, the bed base also includes the wiring or cables for attachment of the control module to the actuators, power sources, wired remotes. In one embodiment, the control module includes communication ports, e.g., USB ports, for communication between the control module and external control and computing resources.

In one embodiment, the foot section first articulating decking portion 146 includes a pair of opposing cylindrical side rails 168 extending along a length of the bed base and pivotally attached to the external pivoting joints 162 of the foot section fixed decking portion. A first rectangular end rail 170 extends along the width of the bed base between the side rails parallel to and adjacent the foot section fixed decking portion. The first rectangular end rail is attached to the internal pivot point 164. A second rectangular end rail 172 extends along the width of the bed base between the side rails and is spaced from the first rectangular end rail. The second rectangular end rail is formed from two separate pieces that each extend only partially between the side rails. This defines a gap 174 in the second rectangular end rail that accommodates operational components of the articulating foot section. This gap allows the operational components of the articulating foot section to be included in the articulating foot section without extending past or outside the top surface of the decking and bottom of the foot section fixed frame. The foot section first articulating decking portion also includes a plurality of internal cross frame members 176 including gussets 178 to provide the desired strength and rigidity to the foot section first articulating decking portion, support for the two separate pieces of the second rectangular end rail and support for the decking.

The foot section includes a foot section second articulating decking portion 148 pivotally attached to the foot section first articulating decking portion and the foot section fixed frame. Suitable materials for the framing of the foot section second articulating decking portion are the same as those for the head section and foot section fixed and articulating frame sections as described herein. In one embodiment, the foot section second articulating decking portion includes a pair of opposing cylindrical side rails 180 extending along a length of the bed base, a cylindrical end rail 182 extending along the width of the bed base at a foot end of the bed base and a rectangular end rail 186 extending along the width of the bed base between the sides rails opposite the cylindrical end rail. The side rails 180 transition to the foot end rail 182 at rounded corners 184 formed from cylindrical tubing. The cylindrical side rails 180 are pivotally attached to the cylindrical side rails 168 of the foot section first articulating decking portion at a pair of pivoting joints 188. In addition, the rectangular end rail 186 is pivotally attached to the second rectangular end rail 172 of the foot section first articulating decking portion at an internal pivot point 190. The rectangular end rail 186 is formed from two separate pieces that each extend only partially between the side rails. This defines a gap 187 in the rectangular end rail that accommodates components of the articulating foot section. This gap allows the operative components of the articulating foot section to be provided without extending beyond the decking and the bottom of the foot section fixed frame or contacting the decking during articulation of the foot section articulating portions.

Foot section second articulating decking portion 148 also includes a plurality of internal cross frame members 192 to provide the desired strength and rigidity to the foot section articulating decking portion, support for the decking and support for actuators and other components of the articulating foot section. One of the internal cross frame members is configured as a rectangular gap spanning member 189 that spans the gap 187 in the rectangular end rail. In one embodiment, the gap spanning member extends between internal cross frame members and has a thickness extending down from the decking that is less than the thickness of the rectangular end rail. This decreased thickness provides for passage and movement of internal components of the articulating foot section.

While the foot section second articulating decking portion can be directly pivotally attached to the foot section fixed frame, preferably, the foot section second articulating decking portion is attached to the foot section fixed frame by a pair of pivot arms 194. Each pivot arm is pivotally attached to one of the internal cross frame members 192 and one of the foot section side frame rails 154 on opposite sides of the foot section fixed frame. The pivot arms are positioned outboard or on external surfaces of the foot section side frame rails. In one embodiment, the bed base includes a mattress support 196 to engage the foot end of the mattress placed on the bed base and to prevent the mattress from migrating over the foot end of the bed base. The mattress support is removable, and the foot section second articulating decking portion includes a pair of internal cross members 198 that provide for support and attachment of the mattress support.

The foot section includes a foot section actuator 200 disposed between the foot section first articulating decking portion and the foot section second articulating decking portion to articulate the foot section first articulating decking portion and the foot section second articulating decking portion with respect to the foot portion fixed frame. The foot section actuator is attached to the internal frame members of the foot section first articulating decking portion and the foot section second articulating decking portion end frame vertical rail 160. The foot section actuator is pivotally attached at both ends. In addition, the foot section actuator passes through the gap 174 in the second rectangular end rail and the gap 187 in the rectangular end rail 186. In one embodiment, the foot section actuator is a linear actuator. Suitable linear actuators are known and available in the art. Extending and retracting the linear actuator moves the foot section first and second articulating decking portions between a flat position illustrated in FIGS. 1 and 2 and an articulated or raised position illustrated in FIGS. 3 and 4. In the flat position the foot section actuator is contained between the decking of the foot section and the bottom of the foot section fixed frame. This provides flat surfaces on the top and bottom of the head section for packaging and shipping and minimizes the overall thickness of the head section and the compact assembly of the bed base.

The center section is disposed between the head section and foot section and includes decking that is aligned with the decking on the head section and the foot section when those sections are in a flat position. In one embodiment, the center section 104 includes a center decking portion. The center decking portion is aligned with the head section and foot section decking portions when the bed base is assembled and in the flat position. Preferably, the center section only includes the center decking portion and does not include any additional fix frame supports. The center decking portion includes a pair of opposing cylindrical side rails 202 extending along a length of the bed base and a pair of rectangular end rails 204 extending along the width of the bed base, e.g., the entire width of the bed base. Suitable sizes, materials and arrangements for the center decking portion side rails and ends rails are the same as discussed herein with respect to other framing members. The center section center decking portion also includes a plurality of internal cross frame members 206 to provide the desired rigidity to the center section center decking portion and support for the decking.

In one embodiment, the internal cross frame members provide for attachment of the center section to the other sections of the bed base. Therefore, the internal cross frame members include at least two cross frame members that, when positioned in the assembled bed base, align with the head section side frame rails 116 and foot section side frame rails 154. As illustrated, a third, central internal cross frame member is also provided. The center section has an overall center section length 112. In one embodiment, the overall center section length is less than about 8 inches, preferably less than about 7.5 inches. The center section is a fixed section and does not articulate with respect to the head section or the foot section.

The bed base includes at least one pair of separate brackets 208. Each bracket is independent of and attachable, e.g., releasably attachable, to each the plurality of separate and independent bed sections to assemble the plurality of bed sections into the bed base. The plurality of separate and independent bed sections when assembled into the bed base are connected only through the pair of brackets. Therefore, when the brackets are removed, the bed sections are independent of each other. In one embodiment, each bracket is attached to one of the head section side frame rails 116, one of the foot section side frame rails 154 and one of the internal cross frame members 202 of the center decking section 104. Therefore, the brackets connect and align the head section, center section and foot section and, in particular, align the head section side frame rails 116 and the foot section side frame rails 154. In addition, the pair of brackets position and align the decking surfaces of the head section, center section and foot section. In one embodiment, the pair of brackets are identical brackets. Therefore, each bracket can be attached at either location in the assembled bed base.

Figure 5:
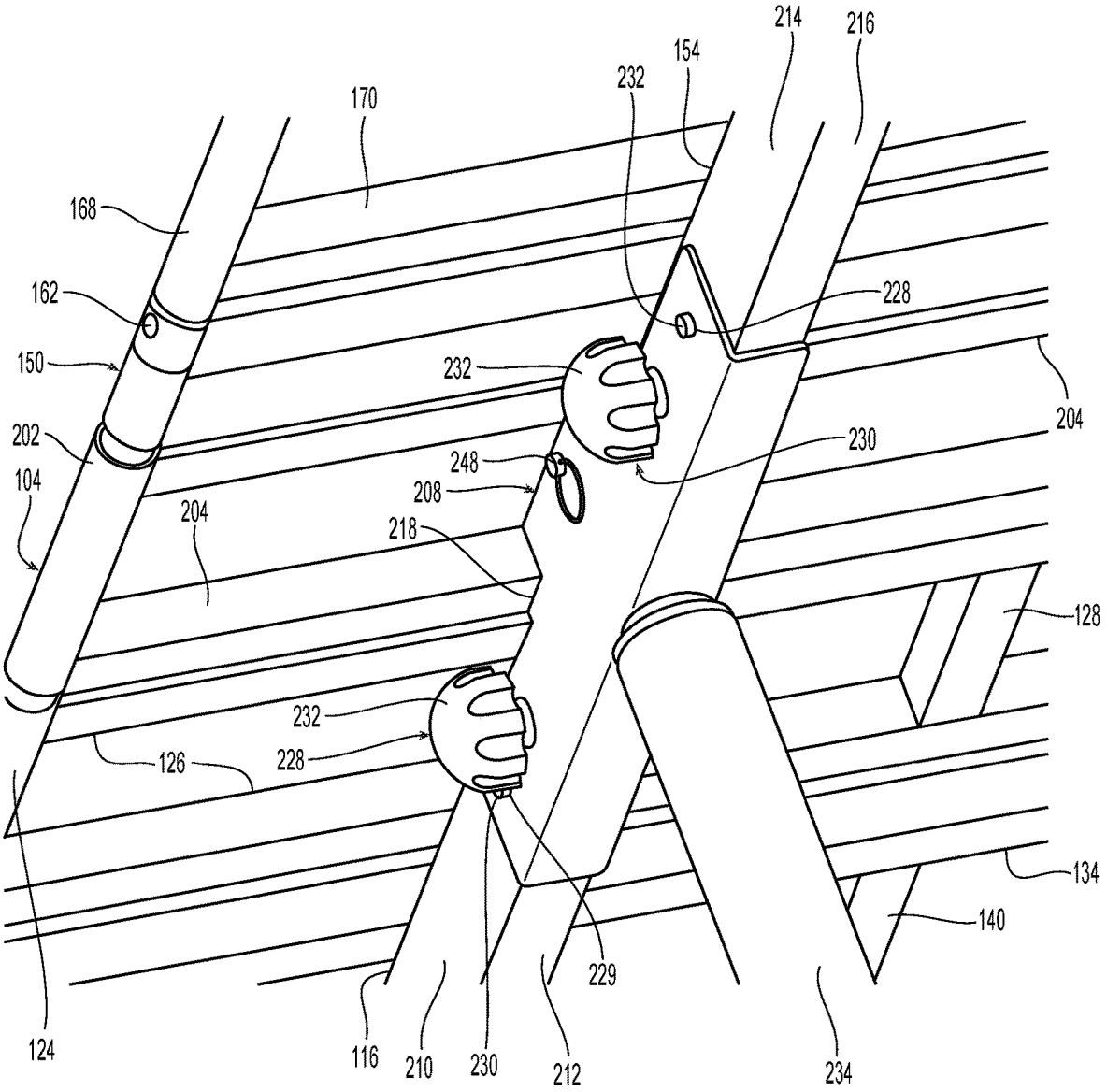
FIG. 5 is a partial perspective view from the bottom of an embodiment of the bed base showing one of the brackets.
Figure 6:
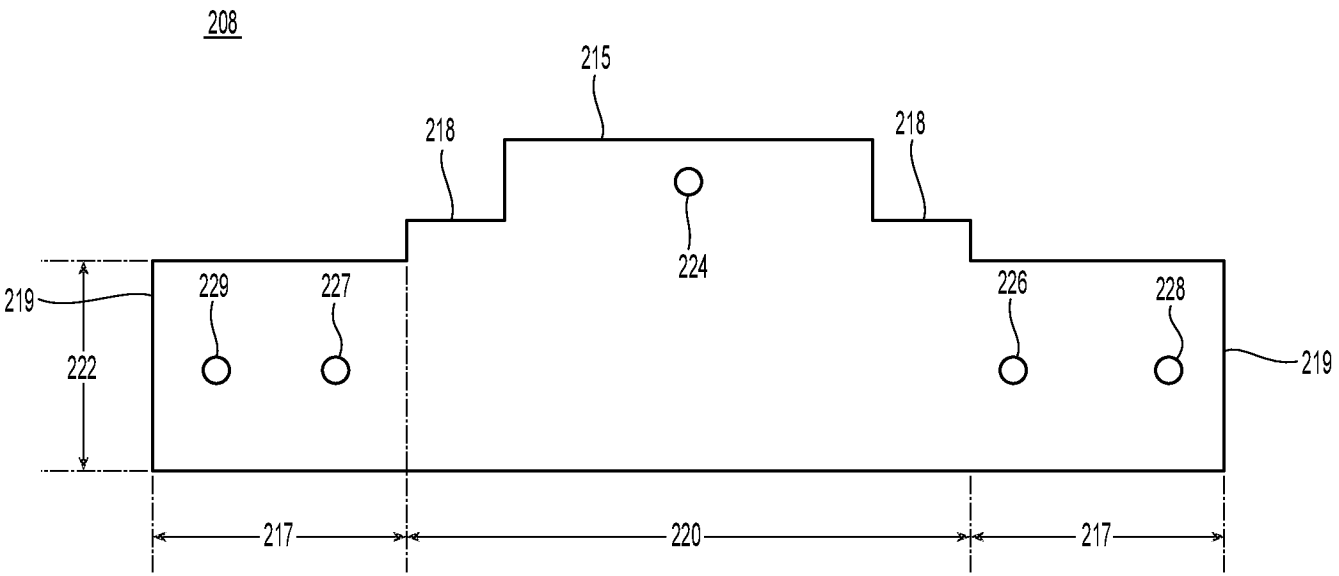
FIG. 6 is a representation of and embodiment of one of the brackets.

Referring now to FIGS. 5 and 6, in one embodiment the bracket 208 has a generally "T" shape when viewed from a side of the bed base or along the width of the bed base. The aligned ends 219 of the "T" shape are attached to the head section side frame rail 116 and the foot section side frame rail 154. The aligned ends have a thickness 222 extending along the head section side frame rails 116 and the foot section side frame rails 154 that is equal to or less than the thickness of the side frame rails. The perpendicular end 215 of the "T" shape is attached to one of the center section internal cross frame members 206 (FIG. 1). In one embodiment, the perpendicular end extends across the internal cross frame member to the bottom surface of the decking or decking material attached to the center decking portion. Suitable materials for the bracket are the same as those for the other frame components of the bed base.

When viewed from an end of the bed base or along the length of the bed base, each bracket can have a "U" shape or and "L" shape. The "L" shaped bracket engages the outside surface of the internal cross frame member 206, the outside surface 210 and bottom surface 212 of the head section side frame rail 116 and the outside surface 214 and the bottom surface 216 of the foot section side frame rail 154. The "U" shaped configuration would also extend at least partially along the inside surfaces of the head section side frame rail 116 and the foot section side frame rail 154 and, if desired, the internal cross frame member 206.

In one embodiment, the head section side frame rails 116 do not extend past the head section fixed decking rectangular end rail 126 adjacent the center section, and the foot section side frame rails 154 do not extend past the foot section fixed decking portion 150. This provides for improved alignment and packing in the compact arrangement as the alignment of the ends of the rails with the decking portions facilitates arrangement of the plurality of section in the compact assembly. While each bracket extends along or overlaps the head section side frame rail 116 and the foot section side frame rail 154 a distance 217 sufficient to provide the desired structural rigidity to the assembled bed base, the bracket 208 maintains a gap 220 between the head section side frame rails 116 and the foot section side frame rails 154. In one embodiment, this gap is at least equal to the overall center section length 112. Therefore, the center section is not positioned over the head section side frame rails 116 and the foot section side frame rails 154 when the bed base is assembled.

In addition, the center section does not rest on the top surfaces of the head section side frame rails 116 and the foot section side frame rails 154. The center section is in contact with and supported by the brackets. In one embodiment, each rectangular end rail 204 of the center section engages and rests on a support portion 218 of the bracket. Each bracket includes two support portions, one for each rectangular end rail. In one embodiment, the rectangular end rails 204 are thinner than the head section fixed decking rectangular end rail 126 and the foot section fixed decking portion 150. Therefore, the bracket in the area of the support portions 218 is thicker than the aligned end thickness 222. This reduced thickness of the rectangular end rails 204 and, therefore, the center section, decreases the overall length of the bed base when arranged as a compact assembly for shipping.

To provide for alignment, attachment of each bracket to the sections of the bed base and ease of assembly of the bed base, each bracket includes at least one center section fastener hole 224, a pair of alignment holes, e.g., a first alignment hole 228 and a second alignment hole 229 and a pair of bracket fastener holes, e.g., a first bracket fastener hole 226 and a second bracket fastener hole 227. Each fastener and alignment hole passes completely through the material of the bracket. For a "U" shaped bracket, each fastener hole passes completely through both sides of the "U" shape. Each hole can be a smooth bore or a threaded bore.

The head section fixed frame includes a pair of head section alignment pins 230, one on each head section side frame rail. Each head section alignment pin is positioned to engage one of the first and second alignment holes of one of the brackets when the bracket is attached to the head section fixed frame. The alignment hole engaged by the head section alignment hole depends on the side of the bed base to which the bracket is attached. Either side of the bracket containing an alignment hole and a bracket fastener hole is identical, so either bracket can be attached to either side of the bed base, facilitating faster and easier assembly. As with the head section fixed frame, the foot section fixed frame includes a pair of foot section alignment pins 232, one on each foot section side frame rail. Each foot section alignment pin is positioned to engage one of the first and second alignment holes of one of the brackets when the bracket is attached to the foot section fixed frame. The head section alignment pins and foot section alignment pins are located on the side frame rails in accordance with the symmetry of the holes in the brackets. The alignment holes and aligned pins provide for placement and alignment of the bracket with the side frame rails. This also aligns the fastener holes in the bracket with corresponding holes in the side frame rails.

After the brackets are placed on the alignment pins of the side frame rails, the center section is placed on the bracket and center section fastener holes 224 are aligned with corresponding internal cross frame members holes 225 (FIG. 1) in the center section. In one embodiment, the internal cross frame members holes 225 pass completely through the internal cross frame members. The internal cross frame members holes 225 can have smooth bores or threaded bores. Preferably, the internal cross frame members holes 225 have smooth bores. This provides for easy attachment of the center section to the bracket using a pair of center section fasteners 248, one for each bracket. Each center section fastener passes through the center section fastener hole of one of the brackets and into the center section, i.e., into the internal cross frame members holes 225. In one embodiment, the center section fasteners are separate from the bracket. Alternatively, the center section fasteners are pins that are spring loaded and attached to each bracket.

The bed base includes a pair of head section fasteners 228. Each head section fastener passes through one of the bracket fasteners hole of one of the brackets and into a corresponding hole in the head section side frame rail. Similarly, a pair of foot section fasteners 230 are provided. Each foot section fastener passes through one of the bracket fastener holes of one of the brackets and into the foot section side frame rail. The corresponding holes in the head section and foot section side frame rails pass at least partially through the frame rails. In one embodiment, the corresponding holes pass completely through the side frame rails. Preferably, the head section fasteners holes and the corresponding holes in the head section and foot section fixed frames, i.e., side frame rails, are threaded holes. Therefore, each one of the head section fasteners and foot section fasteners is a threaded fastener with a knurl knob 232 or other suitable thumb screw that provides for turning of the threaded fasteners by hand. Any suitable type of threaded fastener and knurl knob known and available in the art can be used. The use of threaded holes and threaded fasteners provides for more secure attachment of the bracket to the head section and foot section fixed frames and for a more stable bed base. While illustrated with a pairs of alignment holes and pairs of bracket fastener holes, other numbers and arrangements of alignment holes and fastener holes can be used. In one embodiment, only fastener holes and fasteners or only alignment holes and alignment pins are used.

Referring now to FIGS. 1, 2 and 5, the bed base includes a plurality of leg assemblies 234. The leg assemblies can have a fixed length or can be adjustable leg assemblies with adjustable lengths. Each leg assembly is removably attachable to one of the plurality of separate and independent bed sections or one of the brackets. As illustrated, the bed base includes six leg assemblies. Two leg assemblies at attached to the bottom of each one of the head section, the foot section and the pair of brackets. In particular, the leg assemblies are attached at the corners of the head section and foot section fixed frames. In one embodiment, releasable attachment of the leg assemblies is provided by a threaded attachment; however, any suitable arrangement for providing removable leg assemblies to bed bases can be used.

Figure 7:
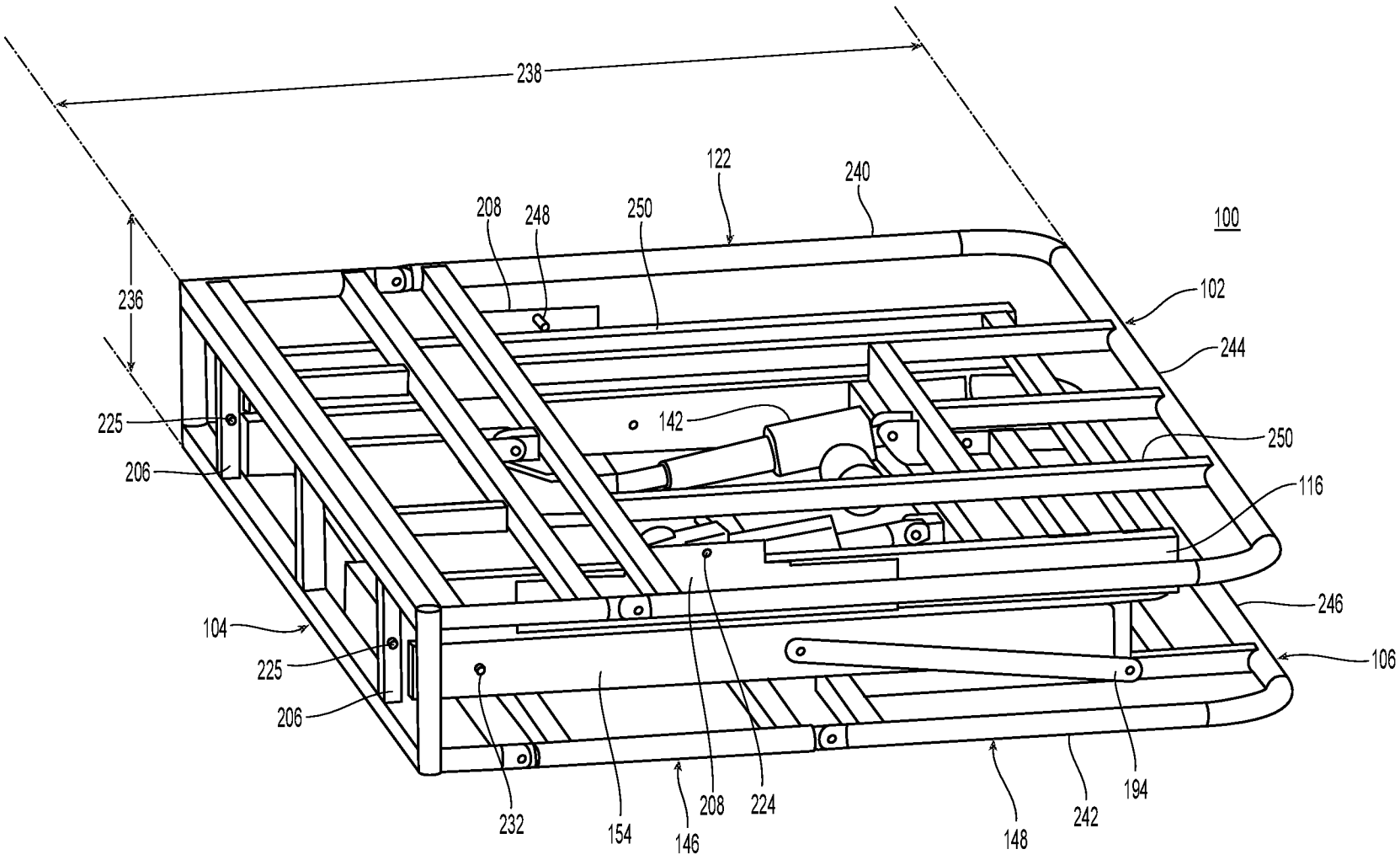
FIG. 7 is a perspective view of an embodiment of a bed base in a compact configuration.

Referring now to FIG. 7, the plurality of separate and independent sections of the bed base 100 are arranged into as a compact assembly. The compact assembly is used for storage and shipment of the bed base. As illustrated, the bed base includes the head section 102, foot section 106 and central section 104. These sections are completely separate and independent structures and are not connected by hinges or other framing members. Therefore, the sections can be positioned and arranged with respect to each other to achieve the optimal or smallest size and shape for shipping and storage. As illustrated, the heat section and foot section are positioned over each other such that the head 244 of the head section is aligned with the foot 246 of the foot section. In addition, the sides of the head and foot sections are also aligned. The head section side frame rails 116 and the foot section side frame rails 154 are overlapped and brought into contact with each other. As all of the components of the head section are contained within the head section side frame rails and below the decking on the head section top surface 240 of the head section, and all of the components of the foot section are contained within the foot section side frame rails and below the decking on the foot section top surface 242, the head section side frame rails 116 and the foot section side frame rails 154 can be brought into direct contact and alignment with each other along their entire lengths.

The additional components of the bed base, e.g., the brackets 208, legs 234, mattress supports 196, and pins and fasteners, are also placed between the head section and foot section top surfaces for shipment or storage with the bed base in the compact configuration. For example, each bracket is placed over a section of one of the head section side frame rails. Each bracket, when placed over a section of one of the side frame rails, engages and extends along the bottom 212 (FIG. 5) of the head section side frame rail in that section. The bracket, however, is taller than the side frame rail, and the center section fastener hole 224 is located above a top surface 250 of the side frame rail. Therefore, in one embodiment, the center section fastener 248 is a spring-loaded fastener attached to the bracket to engage or extend over the top surface 250 of the head section side frame rail. This secures the brackets to the side frame rails within the compact assembly.

The center section 104 is positioned adjacent the head section and the foot section opposite and head and foot. The center section is positioned to extend from the head section top surface 240 to the foot section top surface 242. Therefore, all sections and components of the bed base are configured and sized to fit together and align in the compact assembly. The overall center section length (112 in FIG. 2) defines the height 236 of the compact configuration. Therefore, limiting the overall center section length limits the thickness or height of the compact assembly. In one embodiment, this height is up to about 7.5 inches. In addition, the length 238 of the compact configuration is defined by half the length of the bed base minus the overall center section length plus the thickness of the center section decking portion, i.e., the thickness of the framing members of the center section decking portion. In one embodiment, this length is up to about 33 inches. The width of the compact configuration is defined by the size, e.g., twin or king, of the bed base. The resulting compact configuration is sufficiently small and of sufficiently low weight, e.g., less than about 100 lbs., to be shipped by common carrier within bulky freight, over size or over weight charges. In addition, the lightweight arrangement of sections and bracket provides for shipment directly to a consumer and assembly into the bed base.

In addition, to being configured and shipped as a bed base, including all bed base components as described herein, the bed base can be provided as part of a bed assembly that also includes a mattress (not shown). Suitable mattresses include foam and memory foam mattress. Foam and memory foam mattress can be compressed to a thickness of up to only several inches. Suitable methods for compressing foam mattresses are known and available in the art. In one embodiment, the compressed mattress is wrapped in plastic. Therefore, in one embodiment, a bed assembly include the bed base in the compact assembly. as illustrated in FIG. 7. The mattress is compressed and wrapped around the compact bed base from the head, around the center section and to the foot. The mattress may add about 1 to about 3 inches to the length 238 and about twice as much to the height 238. However, the resulting bed assembly configured for shipping I still meets the desired size and weight restrictions, e.g., up to about 150 lbs., up to 165 inches in length and girth combined or up to 108 inches in length. In one embodiment, the bed base or bed assembly can be held in the compact configuration using, for example, strapping or plastic packaging.

Figure 8:
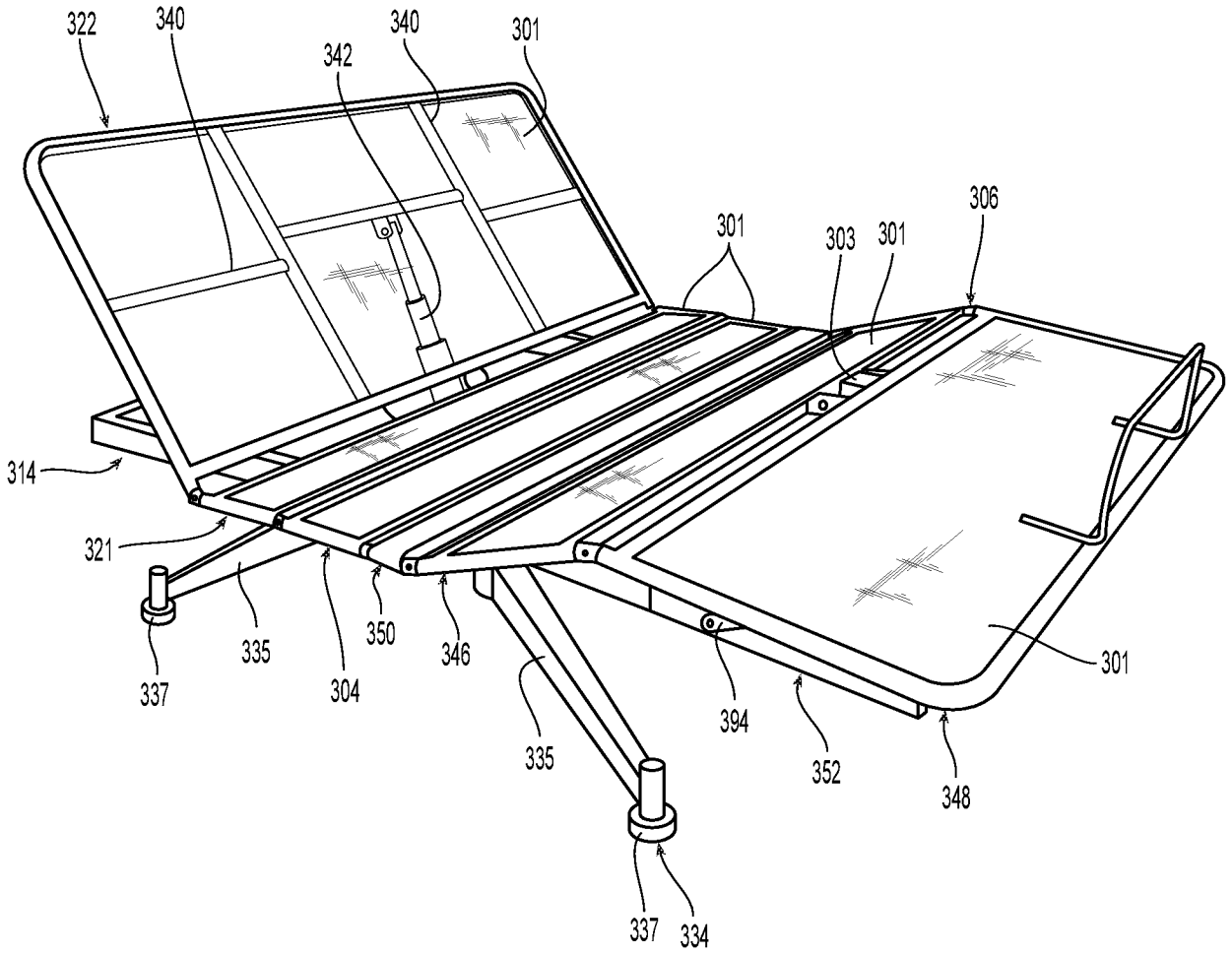
FIG. 8 is a perspective view from the top of another embodiment of a bed base in an assembled and articulated configuration.

Referring now to FIG. 8, another embodiment of a bed base 300 is illustrated with the decking material attached. As with the other embodiments of the bed base, this bed base can be provided as just the bed base or can be included in bed assembly with a mattress. The bed base is an adjustable bed base illustrated assembled and with the various adjustable sections of the bed based in articulated positions. The bed base can also be placed in a flat position and can be disassembled and arranged as a compact assembly as discussed herein. In general, the bed base 300 includes all the framing, decking and operational components as discussed herein in connection with the other embodiments of the bed base.

The bed base includes the plurality of separate and independent bed sections. These sections include the head section containing the head section fixed frame 314 and a head section articulating decking portion 322 with internal frame members 340. The internal frame members and other components located below the decking material are visible through the mesh decking material. The head section articulating decking portion is pivotally attached to the head section fixed decking portion 321 that is fixedly attached to the head section fixed frame. A head section actuator 342 is disposed between the head section fixed decking portion and the head section articulating decking portion to articulate the head section articulating decking portion with respect to the head section fixed frame.

The bed base includes the center section 304 arranged as a center decking section. The bed base includes the foot section 306 containing the foot section fixed frame 352, a foot section fixed decking portion 350, a foot section first articulating decking portion 346 pivotally attached to the foot section fixed frame or fixed decking portion and the foot section second articulating decking portion 348 pivotally attached to the foot section first articulating decking portion and the foot section fixed frame through a pair of pivot arms 394, one on either side of the foot section fixed frame. The foot section also includes a foot section actuator 303 disposed between the foot section first articulating decking portion and the foot section second articulating decking portion to articulate the foot section first articulating decking portion and the foot section second articulating decking portion with respect to the foot section fixed frame.

The bed base includes the pair of brackets as illustrated and described herein that are releasably attachable to each one of the head section fixed frame, foot section fixed frame and the center decking section to align the sections, to secure the sections together and to assemble the sections into the bed base. The bed based includes two leg assemblies 334, one for each side of the bed base. As illustrated, one of the leg assemblies is visible. Each leg assembly is removably attachable to one of brackets on either side of the bed base. In one embodiment, each leg assembly also extends at least partially along the head section side frame rail and the foot section side frame rail. Each leg assembly include two separate legs 335. Each leg includes a telescoping foot 337 to provide for leveling adjustment. Therefore, four legs are provided in two leg assemblies.

Each one of the head section fixed frame 314, a head section articulating decking portion 322, the center decking section, the foot section first articulating decking portion 346 and the foot section second articulating decking portion 348 includes decking 301. The decking forms the top surface of the bed base. The decking is configured to engage the bottom of the mattress placed on the bed base. In one embodiment, the decking is constructed from thin, light weight decking material. Preferably, the decking is constructed from a mesh decking material, for example, a PET mesh. Therefore, the decking is lightweight, and in one embodiment, the mesh allows components of the bed base below the decking to be visible through the decking. While illustrated as mesh decking, any suitable type of light weight decking, including wire, scrim and cloth decking can be used.

The decking is attached to and supported by the framing members of the decking portions located in the fixed and adjustable decking portions of the head section, center section and foot section. In one embodiment, the decking material is wrapped around the frame members before being secured to the frame members. Alternatively, the decking material is secured to the top of the decking framing members. Suitable methods for attaching the decking to the frame include, but are not limited to, using rivets, using a metal member attached to the decking material to slide into a slot in the frame member while stretching the material taut and folding the decking material into a sleeve that is slipped over the frame members. In one embodiment, a separate section of decking or a separate piece of decking material is provided for each decking portion. Each separate section of decking material is mounted on a thin frame having a size corresponding to decking portion. The decking is stretched sufficiently taut on the frame, and the resulting framed decking material is mounted to the frame members in one of the sections of the bed base.

Although the features and elements of the present exemplary embodiments are described in the embodiments in particular combinations, each feature or element can be used alone without the other features and elements of the embodiments or in various combinations with or without other features and elements disclosed herein. Any methods or flowcharts provided in the present application may be implemented in a computer program, software, or firmware tangibly embodied in a computer-readable storage medium for execution by a dedicated computer or a processor.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A bed base comprising: a plurality of separate and independent bed sections comprising:

a head section comprising a head section fixed frame having a pair of head section alignment pins and a pair of head section fastener holes; and a root section comprising a root section fixed frame having a pair of foot section alignment pins and a pair of foot section fastener holes; and a center section;

wherein at least one of the head section and the foot section comprises an articulating bed section; and a pair of independent brackets, each bracket comprises a pair of alignment holes and a pair of bracket fastener holes and is independent of and attachable to the plurality of bed sections to assemble the plurality of bed sections into the bed base;

wherein each head section alignment pin is positioned to engage one of the alignment holes of one of the brackets and to align one of the head section fastener holes with one of the bracket fastener holes of one of the brackets when each bracket is attached to the head section fixed frame, each foot section alignment pin is positioned to engage one of the alignment holes of one of the brackets and to align one of the foot section fastener holes with one of the bracket fastener holes of one of the brackets when each bracket is attached to the foot section fixed frame, and the plurality of bed sections when assembled into the bed base connected only through the pair of brackets.

2. The bed base of claim 1, wherein the pair of brackets comprises identical brackets.

3. The bed base of claim 1, wherein the plurality of bed sections comprises three bed sections.

4. The bed base of claim 1, wherein the head section comprises: a head section fixed frame; and at least one head section decking portion attached to the head section fixed frame, each bracket attachable to the head section fixed frame.

5. The bed base of claim 4, wherein the head section further comprises:

a head section fixed decking portion fixedly attached to the head section fixed frame;

a head section articulating decking portion pivotally attached to the head section fixed frame; and a head section actuator disposed between the head section fixed frame and the head section articulating decking portion to articulate the head section articulating decking portion with respect to the head section fixed frame.

6. The bed base of claim 4, wherein each head section decking portion comprises mesh decking.

7. The bed base of claim 1, wherein the foot section comprises: a foot section fixed frame; and at least one foot section decking portion attached to the foot section fixed frame, each bracket attachable to the foot section fixed frame.

8. The bed base of claim 7, wherein the foot section further comprises:

a foot section first articulating decking portion pivotally attached to the foot section fixed frame;

a foot section second articulating decking portion pivotally attached to the foot section first articulating decking portion and the foot section fixed frame; and a foot section actuator disposed between the foot section first articulating decking portion and the foot section fixed frame to articulate the foot section first articulating decking portion and the foot section second articulating decking portion with respect to the foot section fixed frame.

9. The bed base of claim 7, wherein each foot section decking portion comprises mesh decking.

10. The bed base of claim 1, wherein the center section comprises a center decking portion, each bracket attachable to the center decking portion.

11. The bed base of claim 10, wherein the center decking portion comprises mesh decking.

12. The bed base of claim 1, wherein:

each bracket further comprises a center section fastener hole; and the bed base further comprises:

a pair of center section fasteners, each center section fastener passing through the center section fastener hole of one of the brackets and into the center section;

a pair of head section fasteners, each head section fastener passing through one of the bracket fastener holes of one of the brackets and into one of the head section fastener holes; and a pair of foot section fasteners, each foot section fastener passing through one of the bracket fastener holes of one of the brackets and into one of the foot section fastener holes;

where each one of the head section fasteners and foot section fasteners comprises a threaded fastener with a knurl knob.

13. The bed base of claim 1, wherein the bed base further comprises a plurality of leg assemblies, each leg assembly attachable to one of the plurality of separate and independent bed sections or one of the brackets.

14. The bed base of claim 1, wherein the bed base comprises a weight of less than about 100 lbs.

15. A bed assembly comprising:

a bed base comprising:

three of separate and independent bed sections comprising:

a head section comprising a head section fixed frame having a pair of head section alignment pins and a pair of head section fastener holes, a head section articulating decking portion pivotally attached to the head section fixed frame and a head section actuator disposed between the head section fixed frame and the head section articulating decking portion to articulate the head section articulating decking portion with respect to the head section fixed frame;

a center section comprising a center decking portion; and a foot section comprising a foot section fixed frame having a pair of foot section alignment pins and a pair of foot section fastener holes, a foot section first articulating decking portion pivotally attached to the foot portion fixed frame, a foot section second articulating decking portion pivotally attached to the foot section first articulating decking portion and the foot section fixed frame and a foot section actuator disposed between the foot section first articulating decking portion and the foot section fixed frame to articulate the foot section first articulating decking portion and the foot section second articulating decking portion with respect to the foot section fixed frame;

a pair of independent brackets, each bracket comprises a pair of alignment holes and a pair of bracket fastener holes and is independent of and attachable to the head section fixed frame, foot section fixed frame and the center decking portion to assemble the three bed sections into the bed base, each head section alignment pin positioned to engage one of the alignment holes of one of the brackets and to align one of the head section fastener holes with one of the bracket fastener holes of one of the brackets when each bracket is attached to the head section fixed frame, each foot section alignment pin positioned to engage one of the alignment holes of one of the brackets and to align one of the foot section fastener holes with one of the bracket fastener holes of one of the brackets when each bracket is attached to the foot section fixed frame, and the three bed sections when assembled into the bed base connected only through the pair of brackets; and a plurality of leg assemblies, each leg assembly attachable to the head section fixed frame, the foot section fixed frame, the center decking portion or one of the brackets.

16. The bed assembly of claim 15, wherein the head section articulating decking portion, the center decking portion, the foot section first articulating decking portion and the foot section second articulating decking portion comprise mesh decking.

17. The bed assembly of claim 15, wherein the bed assembly comprises a weight of less than about 100 lbs.

18. A bed base comprising: a plurality of separate and independent bed sections comprising:

a head section having a pair of head section alignment pins and a pair of head section fastener holes; and a foot section having a pair of foot section alignment pins and a pair of foot section fastener holes; and a center section;

wherein at least one of the head section and the foot section COM rises an articulating bed section; and a pair of brackets; each bracket comprising alignment holes and bracket fastener holes, each head section alignment pin positioned to engage one of the alignment holes of one of the brackets and to align one of the head section fastener holes with one of the bracket fastener holes of one of the brackets when each bracket is attached to the head section fixed frame, each foot section alignment pin positioned to engage one of the alignment holes of one of the brackets and to align one of the foot section fastener holes with one of the bracket fastener holes of one of the brackets when each bracket is attached to the foot section fixed frame, and each bracket independent of and attachable to the plurality of bed sections to assemble the plurality of bed sections into the bed base, the plurality of bed sections when assembled into the bed base connected only through the pair of brackets.

* * * * *